United States Patent [19]

Streubel

[11] Patent Number: 4,926,929

[45] Date of Patent: May 22, 1990

[54] DUMMY BAR FOR CONTINUOUS CASTING MACHINES

[75] Inventor: Hans Streubel, Erkrath, Fed. Rep. of Germany

[73] Assignee: SMS Schloemann-Siemag Aktiengesellschaft, Dusseldorf, Fed. Rep. of Germany

[21] Appl. No.: 390,724

[22] Filed: Aug. 8, 1989

[30] Foreign Application Priority Data

Aug. 13, 1988 [DE] Fed. Rep. of Germany ..... 3827582

[51] Int. Cl.[5] ..... B22D 11/08

[52] U.S. Cl. ..... 164/445; 164/425

[58] Field of Search ..... 164/445, 446, 425, 426

[56] References Cited

U.S. PATENT DOCUMENTS

| | | | |
|---|---|---|---|
| 3,262,162 | 7/1966 | Lemper | 164/446 |
| 3,324,934 | 6/1967 | Hess et al. | 164/426 |
| 3,451,466 | 6/1969 | Orr | 164/445 |
| 3,485,292 | 12/1969 | Grothe | 164/445 |
| 3,610,321 | 10/1971 | Khimich et al. | 164/445 |

FOREIGN PATENT DOCUMENTS

| | | | |
|---|---|---|---|
| 2809844 | 9/1978 | Fed. Rep. of Germany . | |
| 2604643 | 4/1988 | France | 164/445 |

*Primary Examiner*—Nicholas P. Godici
*Assistant Examiner*—J. Reed Batten, Jr.
*Attorney, Agent, or Firm*—Wolf, Greenfield & Sacks

[57] ABSTRACT

The dummy bar includes a flexible sheet having several rows of contact elements fastened along a portion of its length to both sides of the sheet. Free projections of contact elements of different rows overlap one another in a lengthwise direction to the dummy bar. In order to create a simple, operationally safe, low maintenance dummy bar the flexible sheet includes recesses corresponding to the projection of the free projections of the contact elements.

13 Claims, 2 Drawing Sheets

DUMMY BAR FOR CONTINUOUS CASTING MACHINES

FIELD OF INVENTION

The invention relates generally to dummy bars for continuous casting machines having an at least partially arc-shaped strand guide whereby on both sides of a flexible metal sheet several rows of contact elements are fastened over a portion of their length and free projections of these contact elements along different rows overlap in a direction longitudinal of the dummy bars.

BACKGROUND OF THE INVENTION

In known dummy bars such as that described in DE-OS 28 09 844, several rows of contact elements are arranged in a staggered distribution next to one another on a flexible sheet of metal. The contact elements have a trapezoidal shape or are skewed to form a bend-free area of overlap and are attached to the sheet metal surface with a small attachment surface.

This prior art dummy bar has the following disadvantages: the metal sheet is only freely bendable in the narrow overlapping areas, and in these areas, notch tensions occur. For this reason the dummy bar is not suited to strand guides with a small radius of curvature. With each contact of the driven rollers of the strand guide with an overlapping region, an overturning moment occurs because of the smaller attachment surfaces of the contact elements which puts too severe a load on their points of attachment.

It is one object of the invention to create a simple, operationally safe dummy bar which is especially suited for continuous casting machines for thin steel strips with a small radius of curvature.

Another object of the invention is to avoid overturning moments in the contact elements and notch tensions.

SUMMARY OF THE INVENTION

For dummy bars of this type, these and other objects are achieved according to this invention by providing the flexible sheet with holes corresponding to the free projections.

Alternatively, the objects of the invention are achieved by providing the dummy bar with several flexible sheet metal strips arranged in spaced relation next to one another. These strips are connected by cross-pieces and pieces with free projections of the contact elements are located in the space between the sheet metal strips.

The dummy bar according to this invention can be manufactured cheaply and is of low maintenance. Operational safety is improved because overturning moments and notch tensions are avoided.

BRIEF DESCRIPTION OF THE DRAWINGS

The objects, advantages and features of this invention will be more clearly appreciated from the following detailed description when taken in conjunction with the accompanying drawings in which.

DETAILED DESCRIPTION OF THE PREFERRED EMBODIMENTS

Figure 1:
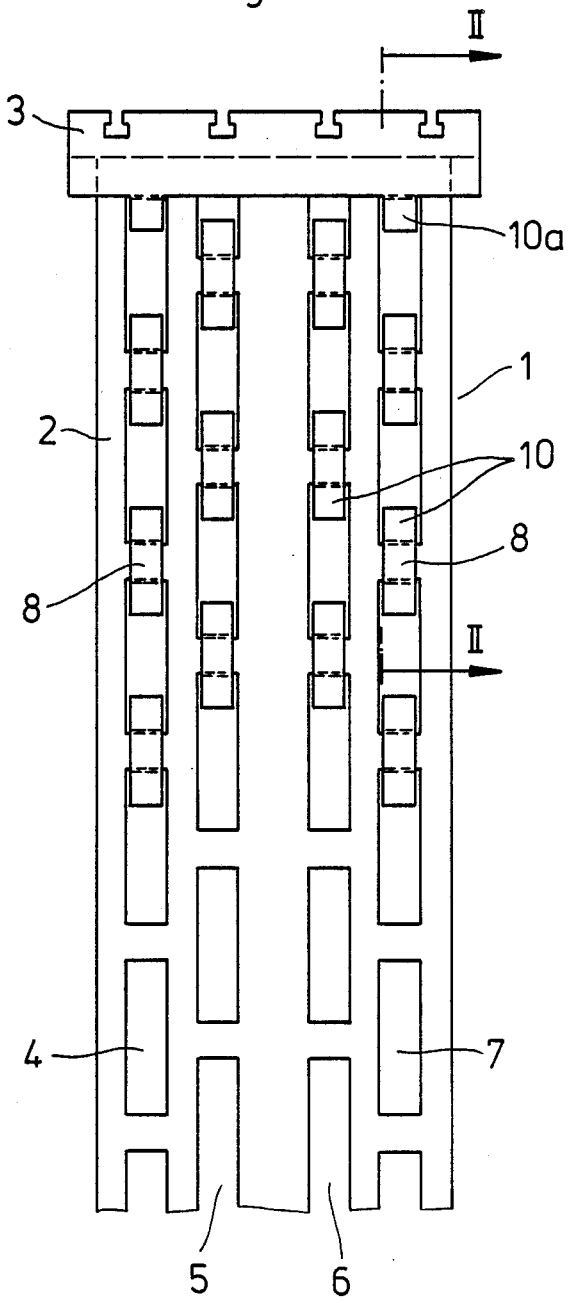
FIG. 1 is a partial view of a dummy bar of this invention with rectangular contact elements.
Figure 2:
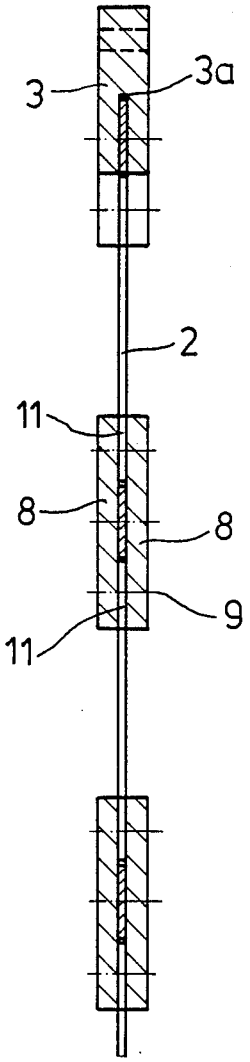
FIG. 2 is an enlarged longitudinal section taken along the line II—II of FIG. 1.

Dummy bar 1 shown in FIGS. 1 and 2 comprises a flexible sheet 2, preferably made of spring steel, at the end of which is attached a dummy bar head 3 for sealing a continuous casting mold and for forming a connection with the cast strip. Sheet 2 is fastened to dummy bar head 3 at slit 3*a* of dummy bar head 3.

Recesses 4, 5, 6 and 7 are disposed in flexible sheet 2 and are arranged in four rows extending in a longitudinal direction with respect to the casting direction, in which each two neighboring rows of the recesses 4, 5, 6 and 7 are staggered in a longitudinal direction with respect to the rows adjacent thereto. Rectangular contact elements 8 are disposed between the recesses on each side of sheet 2 and elements 8 are fastened with rivets 9 and extend over the recesses 4, 5, 6 and 7 with projections 10 which are supported by shims 11. The staggered arrangement of contact elements 8 results in an overlap of their associated projections 10 so that as dummy bar 1 passes through the strand guide of the continuous casting machine, dummy bar 1 forms a contact path for the strand guide rollers (not shown) which is free of holes and therefore smooth. Projections 10*a* disposed on dummy bar head 3 provide a transition to dummy bar head 3.

The contact-free guiding of the projections 10, 10*a* within the recesses 4, 5, 6 and 7 provides a good fit for dummy bar 1 even within a strand guide which has a small radius of curvature. Dummy bar 1 is also usable in a continuous casting machine employing a strand bending system.

Figure 3:
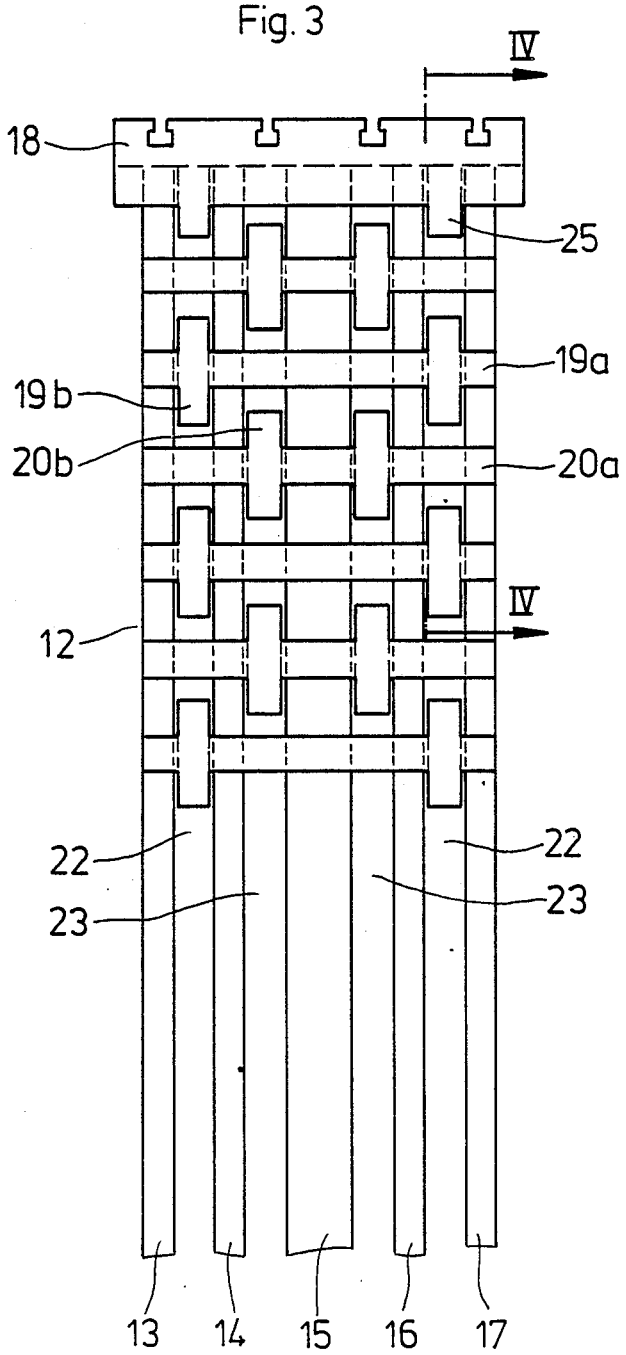
FIG. 3 is a partial view of a dummy bar of this invention made from several sheet metal strips.
Figure 4:
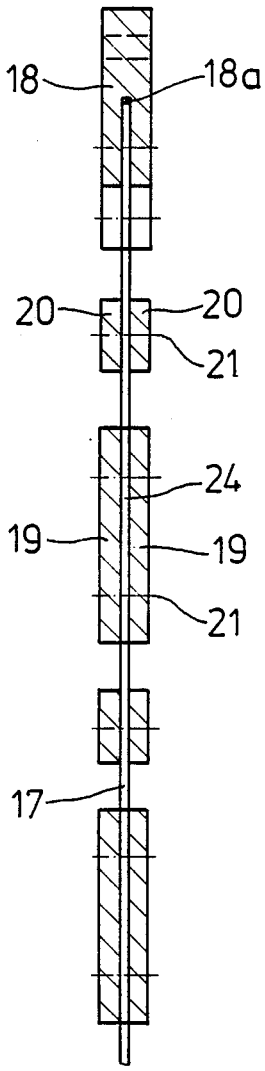
FIG. 4 is an enlarged longitudinal view taken along the line IV—IV of FIG. 3.

An alternative embodiment of the dummy bar of this invention is shown in FIGS. 3 and 4. Dummy bar 12 comprises five flexible strips 13, 14, 15, 16 and 17 arranged in spaced relation next to one another. Strips 13–17 are preferably made of spring steel. Strips 13–17 have been inserted into a slit 18*a* of a dummy bar head 18 and fastened thereto.

Strips 13, 14, 15, 16 and 17 are connected on each lateral side by cross pieces 19*a* and 20*a* of respective contact elements 19 and 20 which are fastened to strips 13–17 by rivets 21. Elements 19 and 20 each have two longitudinal pieces 19*b* and 20*b* respectively. Longitudinal pieces 19*b* and 20*b* of respective elements 19 and 20 extend into respective spaces 22 and 23 between strips 13–17. Thus, longitudinal pieces 19*b* and 20*b* of adjacent contact elements 19 and 20 overlap in a longitudinal direction in the alternating spaces 22 and 23. Shims 24 are disposed between the two portions of contact elements 19 and 20 which are between the respective longitudinal pieces 19*b* and 20*b*.

On the mounting side of dummy bar head 18 there are disposed projections 25 to assure a smooth transition.

The inexpensive dummy bar 12 formed in such a way can be transported evenly and smoothly by the strand guide rollers (not shown), whereby good adaptation to small radii of curvature of the strand guide as well as to small bend radii are possible.

Having described preferred embodiments of the present invention, it should be obvious to those skilled in the art that various modifications and alterations are possible without the departing from the scope of the invention. Such obvious modifications and alterations are intended to be included within the scope of the invention which is not to be limited by the above discussion of the preferred embodiments. The only limitations upon the scope of the invention are defined by the appended claims and their equivalents.

What is claimed is:

1. A dummy bar for continuous casting machines having an at least partially arc-shaped strand guide comprising:

a dummy bar head;

a flexible sheet fastened to said dummy bar head and having rows of contact elements extending longitudinally therealong;

the contact elements being fastened along a portion of their length to said sheet, each of said contact elements in one of said rows having projections which overlap projections of contact elements disposed in others of said rows in a direction longitudinal of said sheet; and recesses disposed along said rows of said flexible sheet, said overlapping projections of each of said contact elements extending into associated ones of said recesses.

2. A dummy bar according to claim 1 wherein said overlapping projections of said contact elements are formed of two spaced portions, one disposed on each side of said sheet, and wherein shims are provided between said two portions of said projections, said shims having a thickness generally equal to that of said sheet.

3. A dummy bar according to claim 1 wherein said contact elements are generally rectangular in shape.

4. A dummy bar according to claim 1 wherein said sheet is forged of spring steel.

5. A dummy bar according to claim 1 wherein said contact elements are connected to said sheet by rivets.

6. A dummy bar according to claim 1 wherein said sheet is secured to said dummy bar head in slits formed on the underside of said dummy bar head.

7. A dummy bar for continuous casting machines having an at least partially arc-shaped strand guide comprising:

a dummy bar head;

a flexible sheet formed of several flexible strips arranged in a generally parallel, spaced relationship with respect to one another and fastened to said dummy bar head;

a plurality of contact elements interconnecting said strips, each contact element having longitudinal pieces extending into spaces disposed between said strips, said longitudinal pieces of each of said contact elements being disposed in spaces spaced longitudinally from longitudinal pieces of others of said contact elements but overlapping longitudinal pieces of others of said contact elements in a longitudinal direction.

8. A dummy bar according to claim 7 wherein each of said contact element has more than one longitudinal piece disposed therealong.

9. A dummy bar according to claim 7 wherein said contact elements are formed of two spaced portions, one portion disposed on each side of said sheet, and wherein shims are provided between said two spaced portions, said shims having a thickness generally equal to that of said sheet.

10. A dummy bar according to claim 7 wherein said contact elements have a generally cross-shape.

11. A dummy bar according to claim 7 wherein said sheet is formed of spring steel.

12. A dummy bar according to claim 7 wherein said contact elements are connected to said sheet by rivets.

13. A dummy bar according to claim 7 wherein said sheet is secured to said dummy bar head in slits formed on the underside of said dummy bar head.

* * * * *